United States Patent [19]

Schumann et al.

[11] Patent Number: 4,543,308

[45] Date of Patent: Sep. 24, 1985

[54] PHOTOGRAPHIC RECORDING PROCESS

[75] Inventors: Hans-Joachim Schumann, Cologne; Hans Öhlschläger, Bergisch-Gladbach; Helmut Kampfer, Cologne, all of Fed. Rep. of Germany

[73] Assignee: Agfa-Gevaert Aktiengesellschaft, Leverkusen, Fed. Rep. of Germany

[21] Appl. No.: 487,855

[22] Filed: Apr. 22, 1983

[30] Foreign Application Priority Data

May 4, 1982 [DE] Fed. Rep. of Germany ..... 3216568

[51] Int. Cl.[4] ..... G03C 11/00; G03C 5/16; G03C 1/46

[52] U.S. Cl. ..... 430/21; 430/139; 430/503; 250/327.2; 250/362; 250/486.1

[58] Field of Search ..... 430/139, 503, 945, 21, 430/30; 250/362, 459.1, 327.2, 483.1, 486.1; 346/135.1; 356/318

[56] References Cited

U.S. PATENT DOCUMENTS

| | | | |
|---|---|---|---|
| 2,865,744 | 12/1958 | Friedman et al. | 430/139 |
| 3,801,324 | 4/1974 | Postal | 430/139 X |
| 4,258,264 | 3/1981 | Kotera et al. | 250/484.1 |
| 4,460,274 | 7/1984 | Schumann et al. | 356/318 |

FOREIGN PATENT DOCUMENTS 1129285 11/1968 United Kingdom .

*Primary Examiner*—John E. Kittle
*Assistant Examiner*—José G. Dees
*Attorney, Agent, or Firm*—Connolly and Hutz

[57] ABSTRACT

For electronic image recording in one or more colors a photographic recording material comprising in at least one layer photo-sensitive silver halide and a compound capable of luminescence is image-wise exposed and developed to produce a latent luminescence image. The image information contained in the latent luminescence image is scanned photoselectively by a luminescence spectroscopic process and is recoded electronically in the form of monochromatic luminescence signals. The process provides images in one or more colors and is highly sensitive. Recording materials of extremely low silver application can be used.

9 Claims, 17 Drawing Figures

$\Phi_D$
D
1,0
0,5
0
1,0
1,5
2,0
2,5
3,0
log H
U 531
L 622
U 449
U 531
U 449
L 622

$\Phi_D$
D
1,5
1,0
0,5
0
L 599
U 531
U 531
L 599
1,0
1,5
2,0
2,5
3,0
log H

ΦD
D
0,15
0,10
1,0
0,5
0
0,02g AgNO3/m2
0,76g AgNO3/m2
1,5
2,0
2,5
log H $\Phi_{\Delta e,\lambda} \cdot 10^{-3}$ 100
75
50
25
0
GS
5,6
7
7
7
6
4
3
2
1
5
400
500
600
λe [nm]

$\Phi_{\Delta e,\lambda} \cdot 10^{-3}$
60
40
20
0
1 2 3 4 5 6 7 8 9 10
11
12
13
14
15
16
17
18
19 20 21 22 23 24 25 26 27 28 29 30
b
t

PHOTOGRAPHIC RECORDING PROCESS

This invention relates to a photographic recording process, in which a latent luminescence image is produced in a photographic recording material by image-wise exposure. The luminescence image thus produced is scanned in a photoselective manner according to the present invention by luminescence spectroscopic processes and is recorded electronically. If the photographic recording material contains luminescence images which correspond to different colors of light, the luminescence signals which are obtained photoselectively may be used for the production of color images.

It is known that the luminescence of chemical compounds can be used to record images or information. A distinction should be made between processes which use silver-containing recording materials, and those processes which are carried out without silver.

In so-called "silver-free" processes, non-luminescent compounds, for example, are converted into compounds which are capable of luminescence by image-wise exposure using high-energy radiation. The image information thus recorded may be visualized in the form of luminescence by irradiating with light of comparatively longer wavelength which excites luminescence (DE-A No. 1,949,605; DE-A No. 2,240,554 and DE-A No. 2,446,700).

Disadvantages of these processes reside in the light instability of the compounds which are capable of luminescence excited by irradiation, while the latent image is being scanned by the exciting radiation, and in the low wavelength selectivity during recording, because short-wave high-energy radiation of the wavelength range of from 200 to 400 nm is required for the conversion of the non-luminescent compounds into compounds capable of luminescence.

Image recording processes which use silver-containing recording materials include those processes in which the compounds which are contained and are capable of luminescence are merely used for the read out of information previously recorded in a silver halide emulsion layer (GB-A No. 1,129,285 and GB-A No. 1,174,131) and those processes in which the compounds capable of luminescence play an essential part during the actual image recording, for example as energy converters in the recording of high-energy radiation in silver halide emulsion layers (U.S. Pat. No. 2,511,462) or during the production of copies (U.S. Pat. No. 2,865,744) as a photo-sensitive substance. In the last mentioned copying process, the compound capable of luminescence (sensitizer) loses its luminescence capability image-wise, depending on the exposure. The luminescence image excited with blue light may then be recorded on a panchromatic recording material for the production of a duplicate of the original. Owing to the low sensitivity (the production of the luminescence image requires several times the exposure which would be necessary for an adequate exposure of the silver halide), this process is only suitable for copying purposes, but not for recording purposes.

Moreover, other processes are known, according to which a recording which has already been produced image-wise is converted into luminescence images by toning processes or by printing processes (EP-A No. 0,012,010 and U.S. Pat. No. 893,003). According to U.S. Pat No. 4,104,519, a silver image which has been produced is scanned by an X-ray, and the X-ray fluorescence signal is recorded electronically.

The known processes have one or more of the following disadvantages:

1. Insufficient sensitivity for visible light
2. Insufficient selectivity for certain spectral ranges.

An object of the present invention is to provide a highly sensitive photographic recording process, by which light of certain spectral ranges may be recorded selectively and by which multi-colored images may be produced with the simultaneous selective recording of light of different spectral ranges.

This invention relates to a photographic recording process, in which a latent luminescence image is produced by the image-wise exposure of a photosensitive photographic recording material, characterised in that a photographic recording material, which contains in at least one layer photosensitive silver halide and at least one compound capable of luminescence, is exposed image-wise and developed, whereby a silver image and a latent luminescence image superimposed on the silver image are produced in at least one layer, and the image information contained in the latent luminescence image is scanned photoselectively by a luminescence spectroscopic process, optionally after the diffusion transfer of the latent luminescence image to a separate image-receiving sheet which is preferably free of silver and silver halide, and is recorded electronically in the form of monochromatic luminescence signals.

Thus, in the recording process of the present invention, a photosensitive photographic recording material which has one or more photosensitive silver halide emulsion layers and contains compounds capable of luminescence which are embedded in the silver halide emulsion layer or layers, is first of all exposed image-wise and developed. The silver halide constitutes the actual photosensitive substance. It may be unsensitized (spectrally) and accordingly may have its sensitivity for the most part in the short-wave part of the visible spectrum or in the longer-wave UV, or may be sensitized by the addition of spectral sensitizers for the longer-wave parts of the visible spectrum. In the present process, at least one compound capable of luminescence is associated with the silver halide. This compound may be one of the spectral sensitizers mentioned or another compound capable of luminescence which does not need to have any spectrally sensitizing properties. A number of examples of compounds capable of luminescence are provided in Example 1.

It has been found that, by image-wise exposure and by subsequent development, the luminescence density of the compound capable of luminescence is modified image-wise, so that a latent luminescence image (for the most part of an opposite gradation) is superimposed on the silver image produced during development. This latent luminescence image may be visualized by exciting with colored light of a suitable wavelength. At least two reasons are responsible for the production of the latent luminescence image. This phenomenon is based to some extent on the image-wise quenching of the luminescence of the compound capable of luminescence, which is at least initially in a uniform distribution, by the silver image produced during development. For the rest, a latent luminescence image is also still maintained in some cases if the image silver has been removed, for example by treating with a bleaching or bleach-fixing bath (color processing).

The latent luminescence image produced during development may be scanned by luminescence spectroscopic processes such as by the process described in DE-A No. 3,038,908 or in the corresponding copending U.S. Pat. application Ser. No. 310,140; filed Oct. 9, 1981, now U.S. Pat. No. 4,460,274. For example, the developed recording material is scanned by a sharply focussed beam of monochromatic light of a wavelength suitable for exciting luminescence and the luminesence radiation which is released as a result of this is intercepted by suitable opto-electronic transducers (photodetectors). The luminescence signals are converted into electronic image point signals dot by dot or line by line and are recorded electronically, optionally after electronic processing (intensification, inversion). The term "electronic recording" is understood to mean the use of electronic means for the immediate production of a visible image (video image, hard copy), or for the storage of the image information in order to produce such a visible image at a later time as desired.

Thus, the process according to the present invention comprises two essential partial steps, that is, firstly the production of the latent luminescence image, and secondly the conversion of the latent luminescence image into electronic image signals.

In the first partial step of this process, a photographic recording material having at least one photosensitive silver halide emulsion layer and at least one compound capable of luminescence contained therein is exposed image-wise and subjected to a processing operation which comprises at least one treatment step, in which a silver image is produced (development). For example, this treatment may be carried out in an aqueous developer bath of a conventional black-and-white or color processing operation. The presence of color couplers or other color formers in the recording material or in the (color) developer bath is possible, but it is not a prerequisite of the present process. To stabilize the developed silver image and for protection against subsequent exposure, it is appropriate to carry out a fixing or stabilizing treatment, for example in a conventional fix bath or blix (bleach fix) bath after the development treatment, optionally after an intermediate rinsing. The fix or blix bath contains a silver halide dissolving compound and the undeveloped silver halide is washed out of the recording matrial in this fixing or stabilizing treatment, or is converted into photoinsensitive silver compounds. However, a fixing treatment of this type may be dispensed with, for example if the second essential partial step of the process (production of the electronic image signals) immediately follows development, without the freshly developed recording material being previously exposed for a comparatively long time to actinic light, for example to daylight. Under certain circumstances, an insignificant change in the image information of the silver image by the exciting light used during scanning may be accepted, as it may generally only have an effect after the electronic image signal has been obtained (and stored).

Since all of the measures of the first essential partial step of the present process (production of the latent luminescence image) may be identical to all of the measures of conventional black-and-white or color processing operations, on condition that the recording material which is used contains at least one compound capable of luminescence in at least one silver halide emulsion layer, which is usually the case (for example, spectral sensitizers), the present process in principle provides the possibility of producing copies, enlargements or video images from black-and-white images or color images produced in a conventional manner, using the second essential partial step via the electronic recording of the image information.

However, one of the advantages of the present process resides in the fact that, owing to the extremely high sensitivity of the luminescence process (detection limit about $10^{-16}$ mol·cm$^{-2}$), only extremely small substance quantities of the compound capable of luminescence and of the silver halide are required. The greatest gradual signal change in luminescence is found in the "shadows", i.e., in the portions of the image in which only little silver or only slight color density has been developed owing to low exposure during development. Where there are higher optical densities, the differentiation in the luminescence decreases notably and the luminescence density asymptotically approaches a low limiting value. Thus, recording materials having a small silver application are particularly suitable for the present process. This application may range within wide limits and may amount to, for example, from 0.02 to 30.0 g of $AgNO_3/m^2$ per layer or trhe equimolar amount in terms of silver halide. However, silver applications of less than 0.2 g of $AgNO_3/m^2$ (per layer) are preferred. The compound capable of luminescence is present in a much smaller concentration. The concentration of this compound is from $10^{-6}$ to $10^{-2}$ mol/mol of $AgNO_3$ depending on the luminescence quantum yield of the compound capable of luminescence. The use of such small quantities of substance for a photographic recording process only seems to be at all possible since, according to the present invention, the highly sensitive silver halide system (intensification factor about $10^6$) is combined with the highly sensitive luminescence process, which results in a further intensification.

Another essential advantage of the present recording process lies in its photoselectivity, i.e. in the selectivity for certain partial ranges of the spectrum or for certain wavelengths of light. On the one hand, this is based on the fact that the photo-selectivity of the silver halide system is fully used (by spectral sensitization) in a known manner for the primary recording (first essential partial step of the process) and, on the other hand, it is based on the condition that the luminescence radiation used for the production of the electronic image signals (in the second essential partial step of the process) only appears in each case in restricted partial ranges of the spectrum. Thus, a progressive total process is produced by the combination of the first essential partial step of the process with the second essential partial step of the process, based on the photoselectivity which is made possible as a result of this. Since the spectral position of the luminescence density maximum is a parameter which is characteristic of the respective compound capable of luminescence, even several compounds capable of luminescence which at the same time are side by side contained in the same recording material are distinguishable by means of their different wavelength during the production of the electronic image signals. Furthermore, in a progressive manner, this provides the possibility of recording color images, and even multi-colored images, using the present process. For this purpose, all that has to be done is to associate different compounds capable of luminescence with different silver halide emulsions of a different spectral sensitivity contained in the same recording material, and the compounds capable of luminescence only have to differ with respect to their luminescence wavelength. It has proved to be particularly favourable that these conditions area already met in many cases by the spectral sensitizers which are used for spectral sensitization. According to experience, there is a conformity with respect to the spectral position of the sensitization maximum and the luminescence density maximum for these compounds, because the sensitizing molecule states (I-bands) are for the most part identical to the excited molecule states capable of luminescence. Accordingly, spectral sensitizers are the compounds capable of luminescence which are preferably used according to the present invention owing to their double function. However, in addition thereto, other non-spectral sensitizing compounds capable of luminescence are also included which may be used instead of the spectral sensitizers or optionally in addition thereto, for example optical brighteners.

A color-photographic recording material having three silver halide emulsion layers of a different spectral sensitivity which are comparatively low in silver content is suitable, for example, for recording a multi-colored image according to the process of the present invention. The silver application of the individual layers may be so low that, during normal development, no silver image or only a faintly visible silver image is developed. For example, silver applications of less than 0.02 of $AgNO_3/m^2$ layer) are included. One of the layers contains, for example, a red sensitizer, for example RS-6, another layer contains a green sensitizer, for example GS-1, and the third layer is predominantly sensitive to blue light, either because of its inherent sensitivity or due to the presence of a blue sensitizer, for example BS-2 (see Example 1 for formulae of the sensitizer dyes). Instead of the blue sensitizer, the last-mentioned layer may also contain another compound capable of luminescence which should have its spectral luminescence maximum as far as possible at a wavelength of less than 500 nm. This recording material preferably does not contain a color coupler or another color former. A recording material of this type is, apart from its small silver application, in principle comparable with a known coupler-free color film with which color images may be produced in a complicated chromogenic processing operation comprising several development steps and several intermediate exposures. However, the silver application of the individual layers in the present case is too small to produce a sufficient color density during processing in the chromogenic processing operation mentioned.

When the recording material which has been described is exposed image-wise, for example in a conventional photographic camera, the corresponding partial images are first of all produced in the form of latent silver images in the three silver halide emulsion layers corresponding to the respective spectral sensitivity and to the exposure with light of the suitable wavelength (e.g. blue, green, red). The corresponding silver images are produced from these partial images by a simple development process, for example using a conventional black-and-white developer bath. However, any other development treatment is possible, by which a latent silver image is converted into a true silver image. The invention profits from the recognition that a corresponding latent luminescence image of an opposite gradation is superimposed on each of the silver images thus produced. This means, for example when the sensitizers BS-2, GS-1 and RS-6 mentioned are used, that a latent luminescence image having a maximum intensity in the emission wavelength $\lambda_e=490$ nm (BS-2) is superimposed on the partial image registered in the blue-sensitive layer, a latent luminescence image of the emission wavelength $\lambda_e=520$ nm (GS-1) is superimposed on the partial image registered in the green-sensitive layer, and a latent luminescence image of the emission wavelength $\lambda_e=689$ nm (RS-6) is superimposed on the partial image registered in the red-sensitive layer. The individual latent luminescence (partial) images are scanned simultaneously or successively dot by dot or line by line by scanning with monochromatic light of suitable exciting wavelengths $\lambda_a$, i.e. they are excited to luminescence and the emitted luminescence radiation is converted into electronic image signals corresponding to the luminescence density which is measured. The partial images which are concerned here are not colored images in the actual sense, but are cclor separations of the colored original to be recorded which are associated with different spectral ranges, from which color separations multicolored images of the original may be reconstructed according to additive or subtractive processes.

The advantage which is associated with a recording material of this type or is associated with the use thereof for the present process is obvious. The small silver application, the simple layer construction (no strain on the layer by color couplers or oil formers) and the simple processing is favourable in terms of cost. The layer thickness of the individual layers and of the complete layer construction may be minimized, which benefits image definition. Owing to the high sensitivity of the process, fine-grained silver halide may be used, which also has a favourable effect on definition. Exposure in a conventional camera is possible and, finally, it is possible to record multi-colored images.

Not only the conventional transparent substrate materials are included as substrates for the photographic recording material used in the present process, but greatly scattering substrate materials, in particular opaque substrate materials, are also advantageously included, for example paper, in particular superficially hydrophobic paper, such as polyethylene-covered paper, or pigmented plastics films (white cello). The multiple scattering light caused by the scattering substrate has a favourable effect on the process of the present invention because, as a result of this, the absorption and the emission probabilities of the compounds capable of luminescence are substantially increased.

Emulsions of silver bromide or mixtures thereof, optionally containing a small amount (for example up to 10 mol %) of silver iodide in one of the natural or synthetic hydrophilic binders which are usually used, preferably gelatin, are suitable as photosensitive emulsions. Fine-grained emulsions are advantageously used, for example, emulsions having an average grain size of up to 0.5 μm, but coarser-grained emulsions may also be used. The emulsions may be chemically sensitized in a known manner, for example by ripening with sulfur compounds or by adding noble metal compounds, in particular gold, platinum, palladium or iridium compounds.

The following are included as spectral sensitizers, for example the conventional mono- or polymethine dyes, such as acid or basic cyanines, hemicyanines, streptocyanines, merocyanines , oxonols, hemioxonols, styryl dyes or other tri- or polynuclear methine dyes, for example rhodacyanines or neocyanines. Sensitizers of this type are described, for example, in the work by F.M. Hamer "The Cyanine Dyes and Related Compounds", (1964) Interscience Publishers John Wiley and Sons.

The spectral sensitizers or the other compounds capable of luminescence which are used according to the present invention are appropriately added in dissolved or dispersed form to the silver halide emulsions which are ready for casting.

It is important in the present process that the spectral sensitizer which is used or the other compound capable of luminescence remains in the layer in a sufficient concentration after coating and processing. Surprisingly, it has been found that the concentration of spectral sensitizer which usually remains in the layer during conventional processing is great enough to form a useable latent luminescence image. In contrast to conventional photographic processes (for example black-and-white) in which, in the interest of achieving colorless layers, those sensitizing dyes are used which may be easily removed from the layers during processing, it is favourable in the present process if the dyes remain as substantially as possible in the recording material during processing. Thus, sensitizing dyes which have a low solubility in aqueous processing baths are preferably used.

The luminescence spectra of layers which contain silver halide and a sensitizing dye usually show, in addition to the luminescence signal of the monomeric dye, another signal, for the most part at longer wavelengths, which is attributed to the silver halide-dye aggregate. The latter usually disappears when the silver halide is removed from the layer by fixing, whereas the former usually appears to a greater extent on the fixed recording material, for example in the absence of silver halide. Thus, it is advisable not only for reasons of image stabilization, but also for the purpose of increasing the luminescence densities, usually to carry out a treatment after the development step, by which treatment a silver halide-free latent luminescence image is obtained. Thus, the developed latent luminescence image may be subjected in conventional manner to a fixing treatment to remove the residual silver halide, or may be transferred to a silver halide-free image-receiving layer by diffusion transfer.

The term "latent image" in the context of this patent specification is understood to mean an invisible image response to a previous image-wise exposure which may be rendered visible by suitable additional measures.

A "latent silver image" thus indicates an image-wise distribution of development nuclei produced in a silver halide emulsion layer by previous image-wise exposure. Because of the low concentration of such development nuclei a latent silver image usually is not visible. However, by development it can be converted into a visible (true) silver image.

A "latent luminescence image" also indicates an invisible image response to a previous image-wise exposure, in this case the image response obtained by image-wise exposure and development of photosensitive silver halide which has associated to it a compound capable of luminescence. This latent luminescence image is rendered visible only temporarily in the event of excitation by light of a suitable wavelength. The latent luminescence image may be an image-wise distribution of the compound capable of luminescence or it may be a uniform distribution of the compound capable of luminescence having superimposed to it a silver image in the same layer.

The scanning operation of the resulting latent luminescence image and conversion of the luminescence signals into electronic image signals is effected by scanning the developed recording material, or the image-receiving layer containing the latent luminescence image, in lines by a beam of light of a wavelength suitable for exciting luminescence. Laser light or light from a monochromatic lamp unit, for example, is suitable as exciting light. The wavelength of the exciting light is appropriately selected such that, in each case, a compound capable of luminescence of the latent luminescence image is specifically excited to maximum luminescence. The following three lasers, for example, are suitable for the excitation of the sensitizers mentioned:

Argon ion laser; $\lambda a = 476.5$ nm (for BS-2)
Argon ion laser; $\lambda a = 514.5$ nm (for GS-1)
Krypton ion laser; $\lambda a = 676.4$ nm (for RS-6).

The multiplicity of available Ar or Kr laser lines allow a substantial co-ordination with a predetermined sensitizer trio.

The luminescence radiation of the individual image dots is converted into electronic signals by suitable photodetectors, which signals may be stored or may be directly used for the initial control of apparatus for temporary image reproduction (television tubes) or for the production of permanent images (image copy, enlargement). Suitable photodetectors include, for example, photodiodes, several of which may be integrated into a so-called photodiode array or into a photodiode row. The latent luminescence image to be scanned is recorded in lines on a photodiode row using a vibrating mirror system, for example, and in each case each image dot of the image line is recorded on a certain photodiode of the photodiode row. Thus, when all the image dots of an image line are simultaneously excited, all the photodiodes of the photodiode row simultaneously respond and each individual photodiode supplies the electronic image signal of the image dot which is recorded thereon. The individual photodiodes of the photodiode row, may, however, also respond successively if the image dots of the image line to be scanned are excited successively to luminescence. However, it is also possible successively to record the individual image dots of an image line to be scanned on a single photodiode or photomultiplier with the assistance of optical deflection means, for example another mirror or a vibratory light conducting arrangement (fibre optics), so that the photodetector successively supplies the image signals of the individual image dots of an image line.

The high resolution which is desired of the images to be recorded according to the present process is achieved by keeping the image dots of the latent luminescence image to be recorded as small as possible. This is effected either for example, by using a sharply focussed exciting light beam, for example in the form of a laser beam, so that in each case only one small dot, i.e., a very narrowly restricted surface region, is ever excited to luminescence, or, if the exciting light is not sharply focussed and correspondingly greater surface regions are simultaneously excited to luminescence, smaller partial regions corresponding to the image dots are selected therefrom by suitable optical means, for example by microscope objectives. In any case, a corresponding electronic signal, the amplitude of which is a measurement of the luminescence density which is measured, is associated with each individual image dot. The line-wise scanning of the latent luminescence image may also be carried out in the so-called "helical scan"

process. In this process, the original, in this case the developed photographic recording material having the latent luminescence image, is clamped on a rotatably mounted drum and is started to rotate rapidly. Excitation and photodetector units for, in each case, one or more of the compounds capable of luminescence which are in the developed recording material are firmly mounted on a movable slide which may be moved parallel to the rotational axis and is moved by precisely the width of one image line during a rotation.

The image information which is obtained in the form of electronic signals is either immediately used for the initial control of suitable image reproduction apparatus, or is initially processed in a known manner by electronic auxiliaries (for example computers) and optionally stored. The term "electronic processing" is understood to mean measures which, by applying electronic means, are used for intensification, image reversal, gradation variation and improvements in the signal-to-noise ratio. Measures of this type are known.

Likewise, processes are known by which electronic image signals are converted into visible images, for example into television pictures (DE-A No. 2,908,533 and DE-A No. 2,912,667) or into reflected or transmitted images on an opaque or transparent substrate (DE-A No. 2,040,665; DE-A No. 2,043,140; DE-A No. 3,033,892; and U.S. Pat. No. 3,842,195).

The present invention will now be described in the following with reference to the Examples and drawings. In the drawings.

Figure 1:
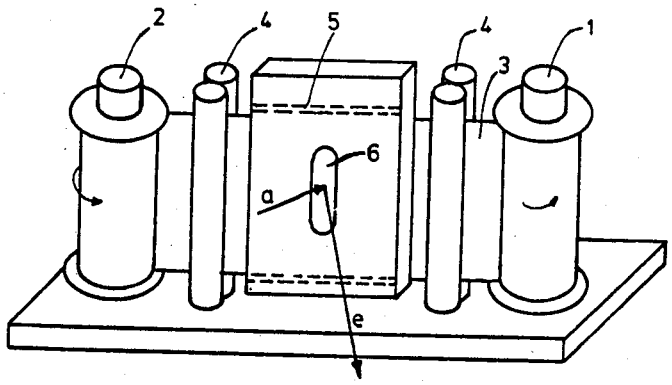
FIG. 1 illustrates a transport apparatus for the luminescence spectroscopic scanning of a test strip.

The color filters used are notated by one of the letters U and L together with a three-digit number. U indicates a band transmission filter transmitting only a part of the visible spectrum while absorbing light of longer or shorter wavelengths. The number indicates the mean value of the wavelengths where the transparency is half the maximum transparency. L indicates an edge filter absorbing light of shorter wavelengths and transmitting light of longer wavelengths. The three-digit number indicates that wavelength where a linear line through points of density 2.0 and 0.3 of the absorption curve intersects the abscissa. More information on color filters is found in the printed publication "AGFA GEVAERT FILTER" by Agfa-Gevaert AG.

EXAMPLE 1

Each of the compounds capable of luminescence which are mentioned in the following (spectral sensitizers and non-sensitizing compounds) were dissolved in methanol, and added in a quantity of 2 mg of substance per 1 g of $AgNO_3$ to a silver chloro-bromide emulsion (56.5 g of $AgNO_3$ per kg of basic emulsion). The wavelength of the luminescence density maximum [nm] is specified in brackets in each case.

1. Perylene (445)
2. 2,7-bis-dimethylamino-9,9-dimethylanthracen-10-one (445)
3. 4,6-dimethyl-7-(N-ethylamino)coumarin (450)
4. 3-nitro-N,N-dimethylaniline (524)
5. Coumarin 153 (540)

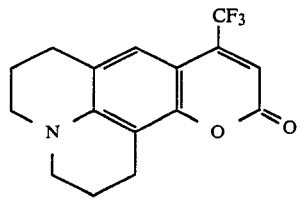

6. Cresyl violet [CAS Reg. No. 10510-54-0] (628)

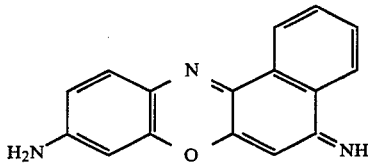

For the following compounds, two wavelengths [nm] are provided in brackets, the first wavelength of which relates to absorption and the second relates to luminescence of the emission product spectra. The expression "emission product spectrum" characterizes the product of absorption spectrum and emission spectrum and is explained in DE-A No. 3,038,908.

7. White toners corresponding to the formula: (408/420)

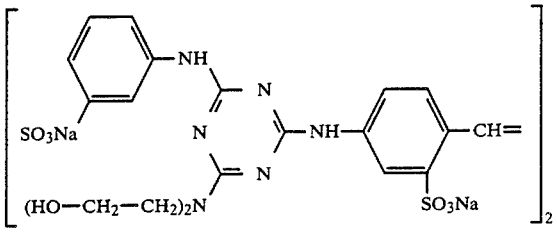
8. Rhodamine 6G [CAS Reg. No. 989-38-8] (560/572)
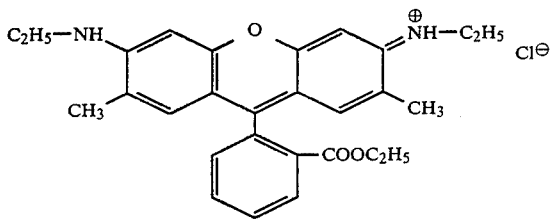
9. Rhodamine B (CAS Reg. No. 81-88-9) (568/580)
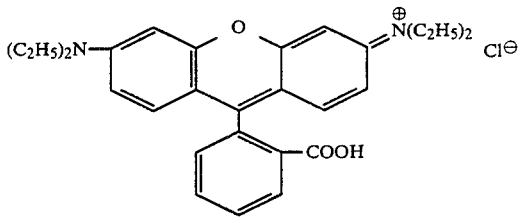
10. BS-1 (BS=Blue Sensitizer) (438/448)
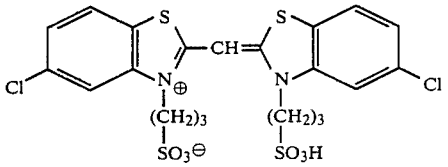
11. BS-2 (480/490)
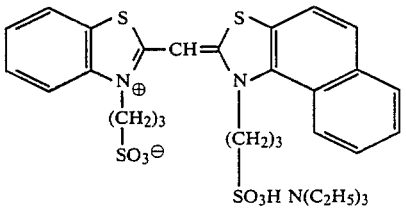
12. GS-1 (GS=Green Sensitizer) (512/520)
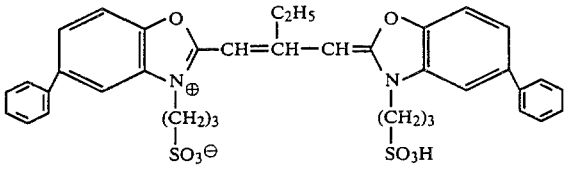
13. GS-2 (511/523)
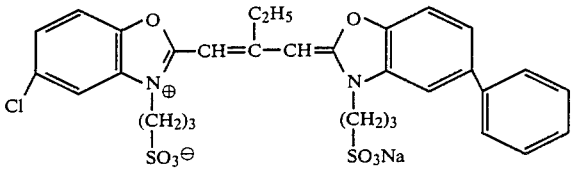
14. GS-3 (514/522)
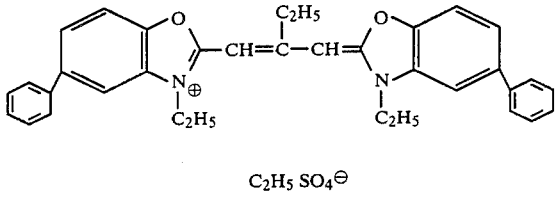
15. RS-1 (RS=Red Sensitizer) (575/585)
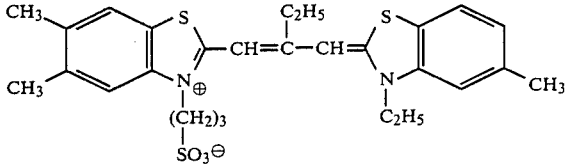
16. RS-2 (560/570)
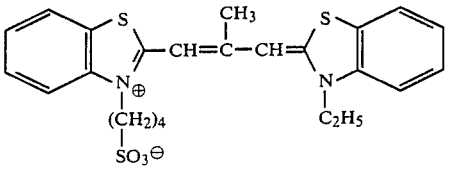
17. RS-3 (600/610)
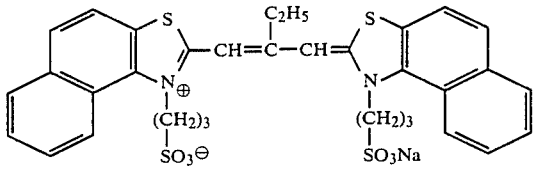
18. RS-4 (667/677)
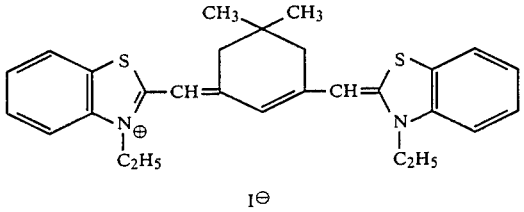

19. RS-5 (670/680)

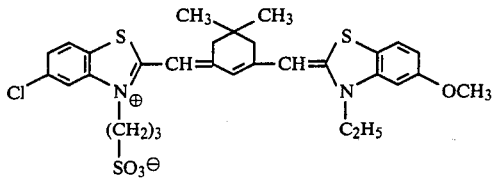

20. RS-6 (679/689)

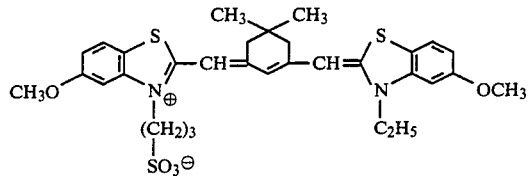

The mixture was then diluted with double the quantity of 5% gelatin solution and was cast on a substrate with a silver application ($AgNO_3$) of from 0.77 to 0.85 g/m$^2$. A polyethylene-coated paper was used as the substrate in almost all cases (except for No. 7). The substrate in No. 7 (optical brightener) was clear cello.

A sample 250 mm long and 35 mm wide was taken from each of the recording materials thus obtained and was exposed behind a step wedge ($\Delta D$/step=0.15) with blue light ( color separation filter U 449) and was subjected to a black-and-white development as follows at 22° C.:

Developer I—1.5 min
- 750 g of water (40°-50° C.)
- 50 g of sodium sulphite sicc.
- 8 g of hydroquinone
- 0.3 g of phenidone
- 40 g of sodium carbonate
- 1.5 g of potassium bromide
- made up with water to 1000 ml Rinsing—1 min Fixing—5 min
- 88 g of sodium thiosulfate
- 12 g of potassium disulfite
- made up with water to 1000 ml Rinsing—10 min.

The luminescence densities were determined from the test strips thus obtained, at the specified wavelengths of the luminescence density maximum, by scanning the test strip with an excitation beam a and automatically registering the luminescence. A transport apparatus according to FIG. 1 was used as a continuous measuring device for test strips.

FIG. 1 illustrates a transport apparatus comprising an unwinding device 1 and a winding device 2 for the test strip 3. Guide rollers 4 are positioned between the winding devices 1, 2 and a measuring plate 5 having a device for flatly pressing on the test strip 3 is located between the guide rollers 4. The measuring plate 5 is provided with a measuring window 6 at which the light beam of the excitation a is directed which produces the emission beam on the test strip 3. The winding devices 1, 2 are driven in the direction of the arrows in a conventional manner by a synchronous motor (not shown).

The transport apparatus with the inserted test strip was introduced into an apparatus for measuring luminescence, essentially comprising a light source, two double monochromators, an excitation radiation measuring device, a transmission measuring device and an emission detector, for example FLUOROLOG, a computer-controlled emission spectrometer manufactured by SPEX, USA.

The exciting beam a impinged on the test strip 3 in a exciting light spot 2.5 mm wide and 10 mm high. The excitation and emission wavelengths were adjusted to maximum intensity of the luminescence radiation of the relevant compound and the test strip 3 was measured under this adjustment.

Figure 2:
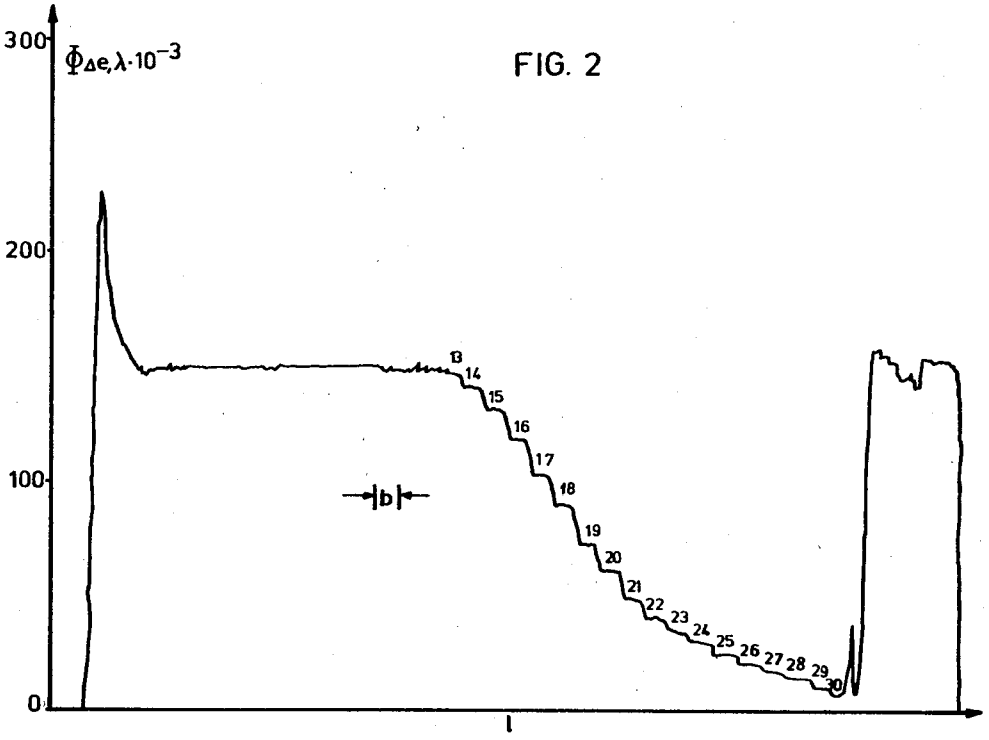
FIG. 2 illustrates a luminescence density curve of perylene in a silver chloro-bromide emulsion after separation exposure (U 449) and black-and-white processing.

FIG. 2 is a typical measurement curve which was obtained according to this measuring process from the example of compound 1 (perylene). The spectral photon flux density (luminescence density), unit $\Phi\Delta e,\lambda$=-photons.s$^{-1}$.m$^{-1}$.cm$^{-2}$.sr$^{-1}$, is plotted as the ordinate against the length 1 of the test strip as the abscissa. The numbers relate to the numbering of the wedge steps (width b=6.35 mm) towards increasing optical density. The silver application was 0.83 g $AgNO_3$/m$^2$. The exciting light had a wavelength $\lambda a$=433 nm with a band width $\Delta\lambda a$=5 nm. The luminescence radiation was measured at $\lambda e$=445 nm with a band width of 2 nm.

EXAMPLE 2

Blue-, green- or red-sensitized silver chlorobromide emulsions were each cast on a substrate of polyethylene-coated paper with a silver application of 0.4 g of $AgNO_3$/m$^2$. They were conventional black-and-white emulsions which did not contain any couplers or other color formers. The sensitizers were contained in a concentration of $10^{-4}$ mol per mol of silver halide. The recording materials were exposed behind a step wedge and behind the separation filters (U 449, U 531, L 622) corresponding to the respective sensibilization and were subjected to black-and-white development, as described in Example 1.

Figure 3:
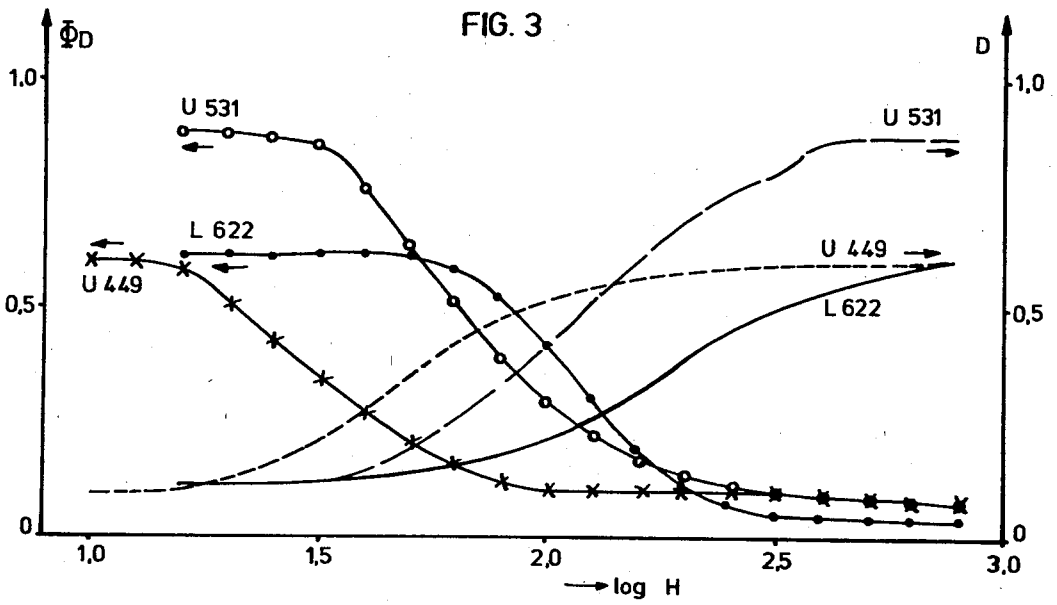
FIG. 3 illustrates silver density curves and blue, green or red-sensitized individual layers; separation exposure and black-and-white processing.

In FIG. 3, the silver densitities D (right-hand ordinate; positive increase) and the corresponding (normalized) luminescence densities $\Phi_D$ (left-hand ordinate; negative increase) are plotted, depending on the exposure log H, for the three separation exposures blue (U 449 green (U 531) and red (L 622).

Measurement Conditions:

| | $\lambda a$ | $\Delta\lambda a$ | $\lambda e$ | $\Delta\lambda e$ [nm] | $K_e \cdot 10^{-4}$ |
|---|---|---|---|---|---|
| BS-1 | 438 | 5 | 448 | 5 | 6.87 |
| GS-1 | 512 | 5 | 520 | 2 | 7.85 |
| RS-4 | 667 | 5 | 677 | 5 | 1.06 |

$K_e$ is the normalization factor (see Example 6).

EXAMPLE 3

The process was tested on a commercial multilayer color reversal film without embedded couplers (KODACHROME 25). A first sample and a second sample were subjected to black-and-white processing behind a step wedge (step constant $\Delta D$/step=0.15), as described in Example 1, after separate exposure to green (U 531) or red (L599).

Figure 4:
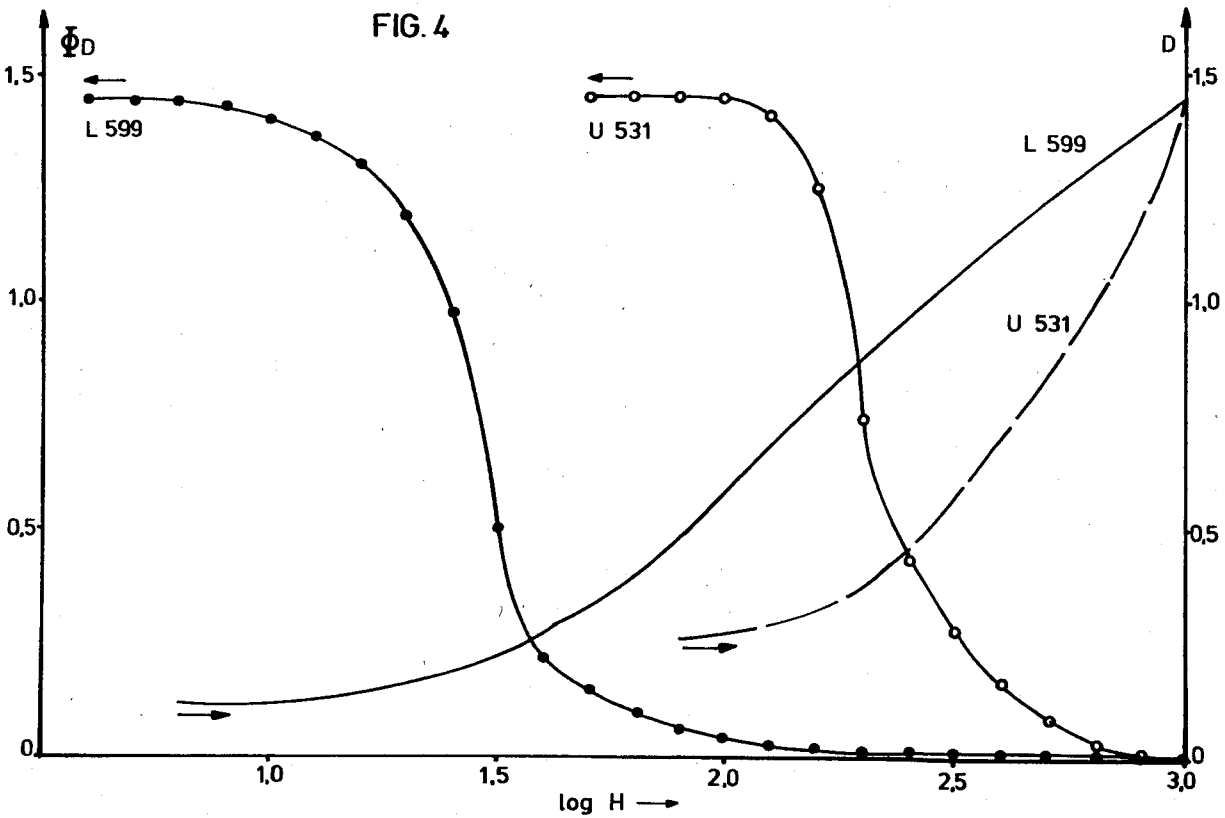
FIG. 4 illustrates color reversal film without couplers; separation exposure (U 531 and L 599) and black-and-white processing.

The silver densities D which were obtained (right-hand ordinate) and the corresponding normalized luminescence densities $\Phi_D$ (left-hand ordinate) are plotted in FIG. 4, depending on the exposure log H (same representation as in FIG. 3).

Measurement Conditions:

| | λa | Δλa | λe | Δλe [nm] | $K_e \cdot 10^{-4}$ |
|---|---|---|---|---|---|
| GS (U 531) | 504 | 5 | 514 | 5 | 0.612 |
| RS (L 599) | 568 | 5 | 578 | 5 | 1.22 |

Figure 5:
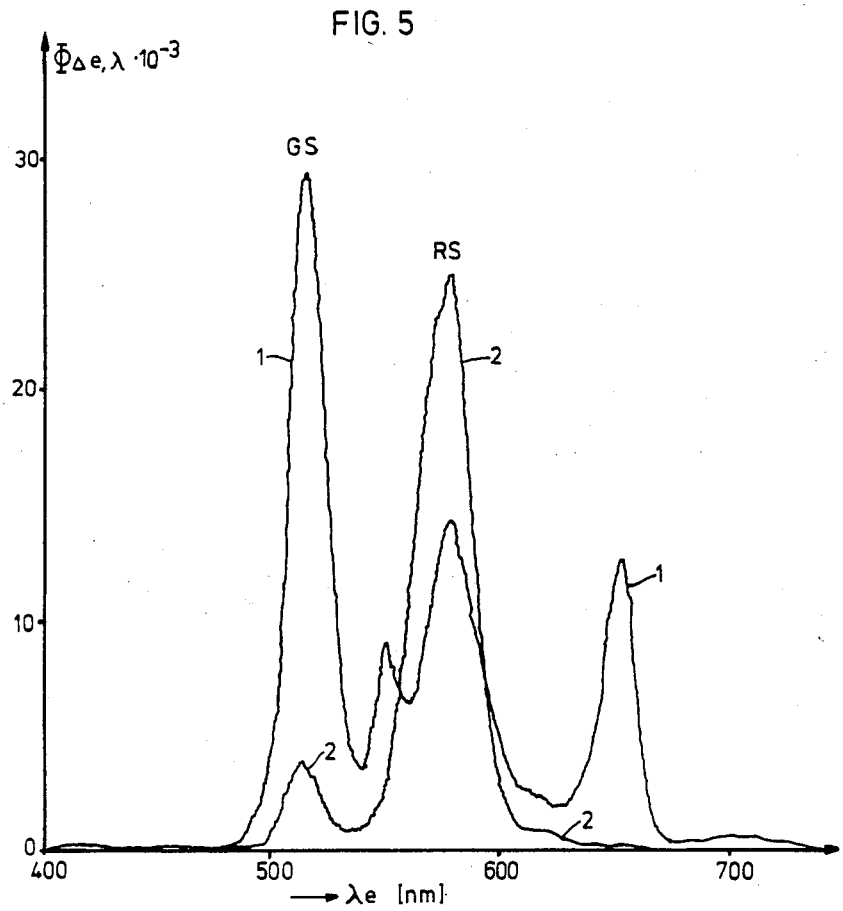
FIG. 5 illustrates color reversal film without couplers; emission product spectrum.

A third sample of the color reversal film mentioned was subjected to the black-and-white processing described in Example 1, without exposure. A fourth sample was tested in an unprocessed condition for comparison. The so-called emission product spectra (product of absorption and luminescence spectra) of these two samples are plotted in FIG. 5 (recorded in the emission spectrometer FLUOROLOG produced by SPEX, USA). The wavelength of the exciting radiation λa is displaced to shorter wavelengths compared to the wavelength of the registered emission λe constant by $\Delta\lambda=\lambda e-\lambda a=8$ nm and was varied over the complete spectral range with the spectral band $\Delta\lambda a=5$ nm synchronously with λe($\Delta\lambda e=2$ nm) while maintaining the spacing Δλ. The luminescence signals of the green sensitizer GS may be recognized at 514 nm and of the red sensitizer RS at 578 nm in curve 1 (spectrum of the unprocessed sample). In addition thereto, the signals of the silver halide-dye aggregates which only appear in the presence of silver halide are present at 550 nm (GS) and at 654 nm (RS). These last mentioned signals are missing in curve 2 (spectrum of the processed sample).

EXAMPLE 4

Several recording materials having different silver applications ranging from 0.02 to 30 g of $AgNO_3/m^2$ were produced using a silver halide emulsion which was rich in silver and contained $2.14 \cdot 10^{-4}$ moles of green sensitizer GS-2 per mol of silver halide. For this purpose, the emulsion which has been described was diluted with different quantities of a 5% gelatin solution and cast onto a substrate of polyethylene-coated paper.

Figure 6:
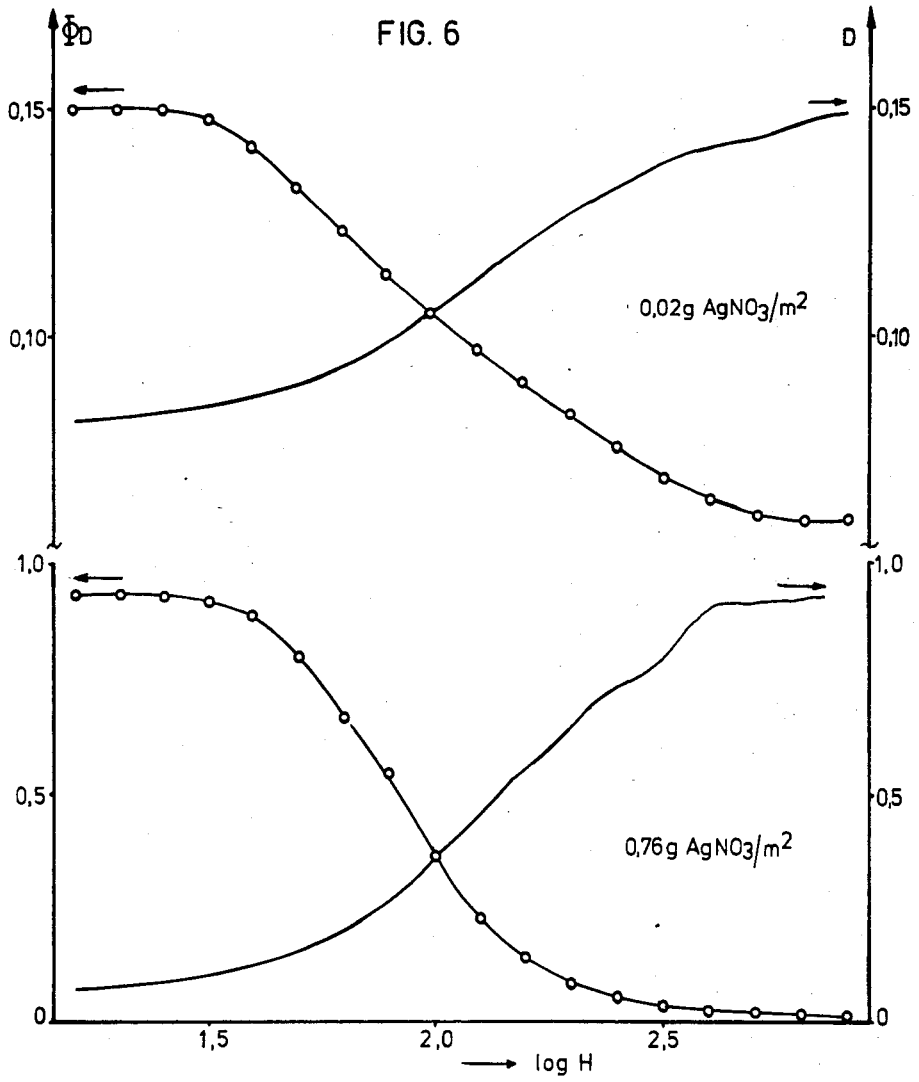
FIG. 6 illustrates green-sensitized individual layers; separation exposure (U 531) and black-and-white processing.

In FIG. 6, the luminescence densities and the silver densities are plotted which were determined on the recording materials having silver applications of 0.02 and 0.76 g of $AgNO_3/m^2$ after exposure to green light (separation filter U 531) behind a grey step wedge and after black-and-white processing, as described in Example 1) (same representation as in FIG. 3).

Measurement Conditions: λa/Δλa/λe/Δλe=511/5/523/2 nm.

Normalization factor $K_e$(GS): 0.02 g $AgNO_3/m^2$, $K_e$(GS)=$4.83 \cdot 10^4$. 0.76 g $AgNO_3/m^2$, $K_e$(GS)=$9.94 \cdot 10^4$.

EXAMPLE 5

Figure 7:
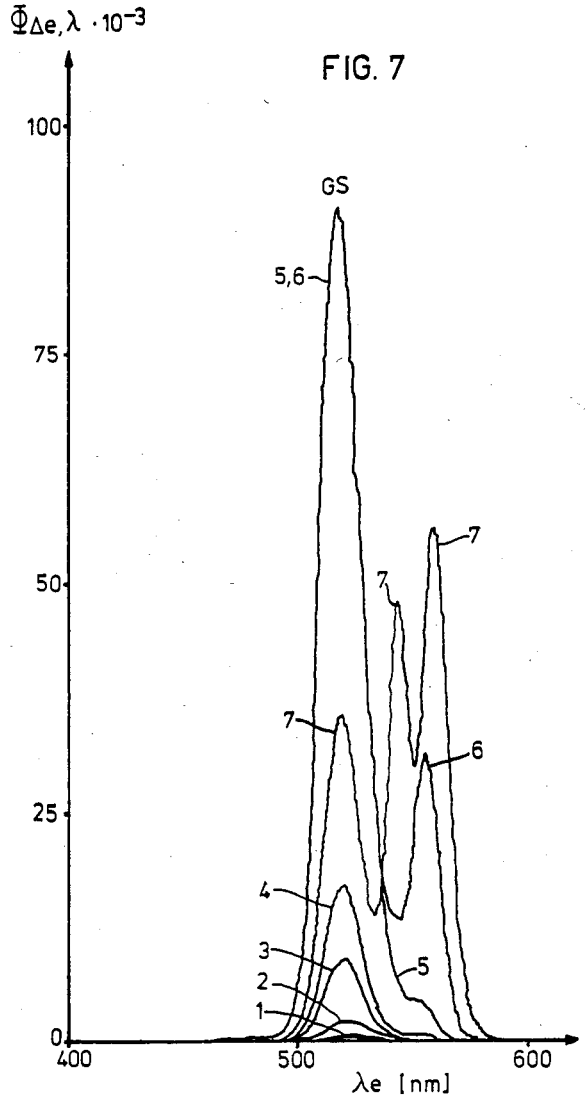
FIG. 7 illustrates green-sensitized individual layers; emission product spectra; concentration series.

Increasing quantities of green sensitizer GS-1 (1:250 in methanol) were added to a silver chloro-bromide emulsion. The emulsion samples thus obtained were each cast on a substrate of polyethylene-coated paper (wet layer thickness 38 μm). The silver application of all the samples ranged between 0.78 and 0.8 g of $AgNO_3/m^2$. The emission product spectra of the green sensitizer GS-1 are represented in FIG. 7 for the samples which are specified in the following.

| Sample | (Mol GS/Mol $AgNO_3$) |
|---|---|
| 1 | 0 |
| 2 | $2.10^{-6}$ |
| 3 | $1.10^{-5}$ |
| 4 | $2.10^{-5}$ |
| 5 | $1.10^{-4}$ |
| 6 | $2.10^{-4}$ |

-continued

| Sample | (Mol GS/Mol $AgNO_3$) |
|---|---|
| 7 | $2.10^{-3}$ |

Figure 8:
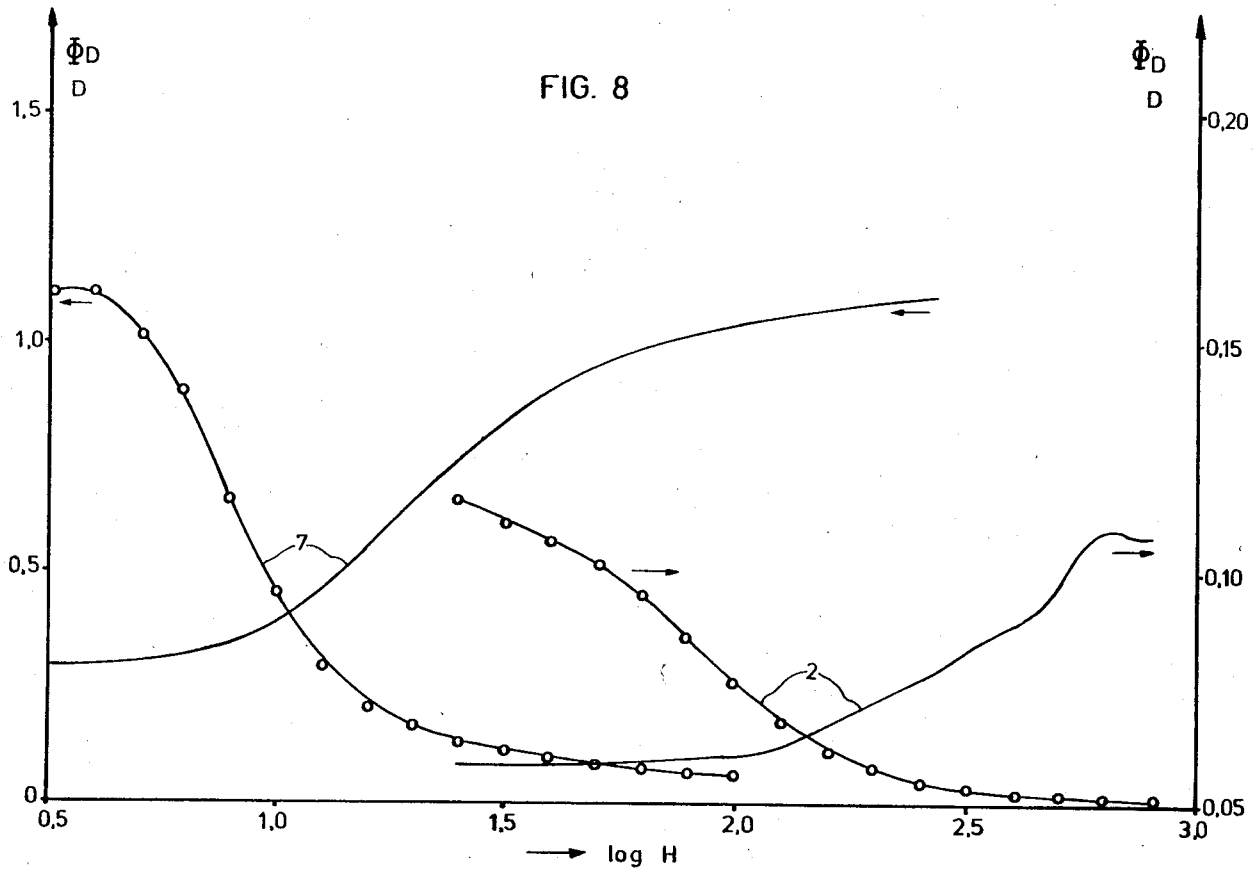
FIG. 8 illustrates green-sensitized individual layers; separation exposure (U 531) and black-and-white processing; concentration series.

FIG. 8 provides a representation of the silver densities and the luminescence densities after green separation exposure (U 531) and after black and white processing (as in Example 1) for sample 2 (curves 2; right-hand ordinate scale D and $\Phi_D$) and for sample 7 (curve 7; left-hand ordinate scale D and $\Phi_D$) (represented otherwise as in FIG. 3).

Sample 2

$K_e$(GS)=$3.05 \times 10^3$; 0.78 g $AgNO_3/m^2$

Sample 7

$K_e$(GS)=$3.85 \times 10^4$; 0.79 $AgNO_3/m^2$

Measurement Conditions: λa/Δλa/λe/Δλe=512/5/520/2 nm.

EXAMPLE 6

A multi-layer color-photographic recording material having an opaque substrate (COLORPAPIER) was produced by applying the following layers in the specified sequence on a paper substrate which was coated on both sides with polyethylene.

1. Blue-sensitive layer with yellow coupler
2. Protective layer
3. Green-sensitive layer with magenta coupler
4. Protective layer
5. Red-sensitive layer with cyan coupler
6. Protective layer.

The photosensitive layers contained a silver bromide emulsion with a silver application in each case of 0.5 g of $AgNO_3/m^2$ and a spectral sensitizer for the respective partial range of the spectrum, that is, in the following quantities, based on 1 mol of $AgNO_3$:

Blue-sensitive layer—$3.2 \times 10^{-4}$ mol BS-1

Green-sensitive layer—$3.1 \times 10^{-4}$ mol GS-1

Red-sensitive layer—$1.2 \times 10^{-4}$ mol RS-4.

The layers were exposed behind a step wedge (ΔD/step=0.1) and with blue, green, red or white light (separation filters U 449, U 531, L 622 or daylight filter). The exposed recording material was then subjected to black-and-white processing, as described in Example 1.

Figure 9:
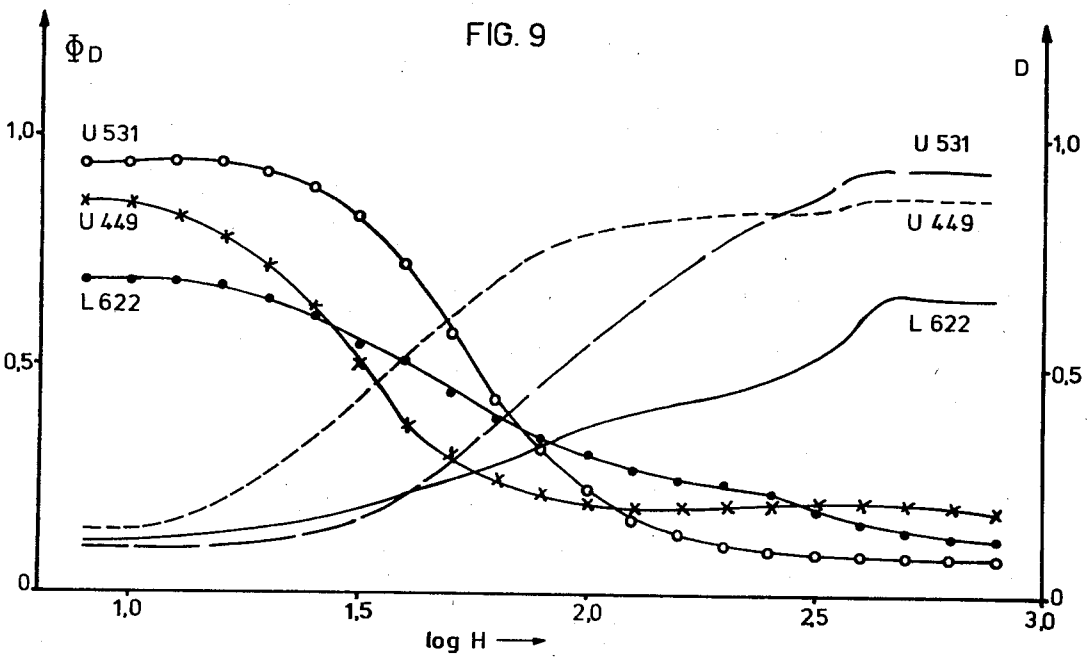
FIG. 9 illustrates color paper; separation exposure and black-and-white processing.

The silver densities D and the luminescence densities $\Phi_D$ for the separation exposures blue (U 449), green (U 531) and red (L 622) are represented in FIG. 9. Measurement conditions—as in Example 2. The normalization factors $$K_e = \frac{\Phi\Delta e.\lambda}{\Phi_D}$$

where $\Phi_D$=Dmax of the black-and-white (or color) development, were:

$K_e$(BS-1)=$5.69 \times 10^4$ $K_e$(GS-1)=$8.23 \times 10^4$ $K_e$(RS-4)=$1.31 \times 10^4$.

Figure 10:
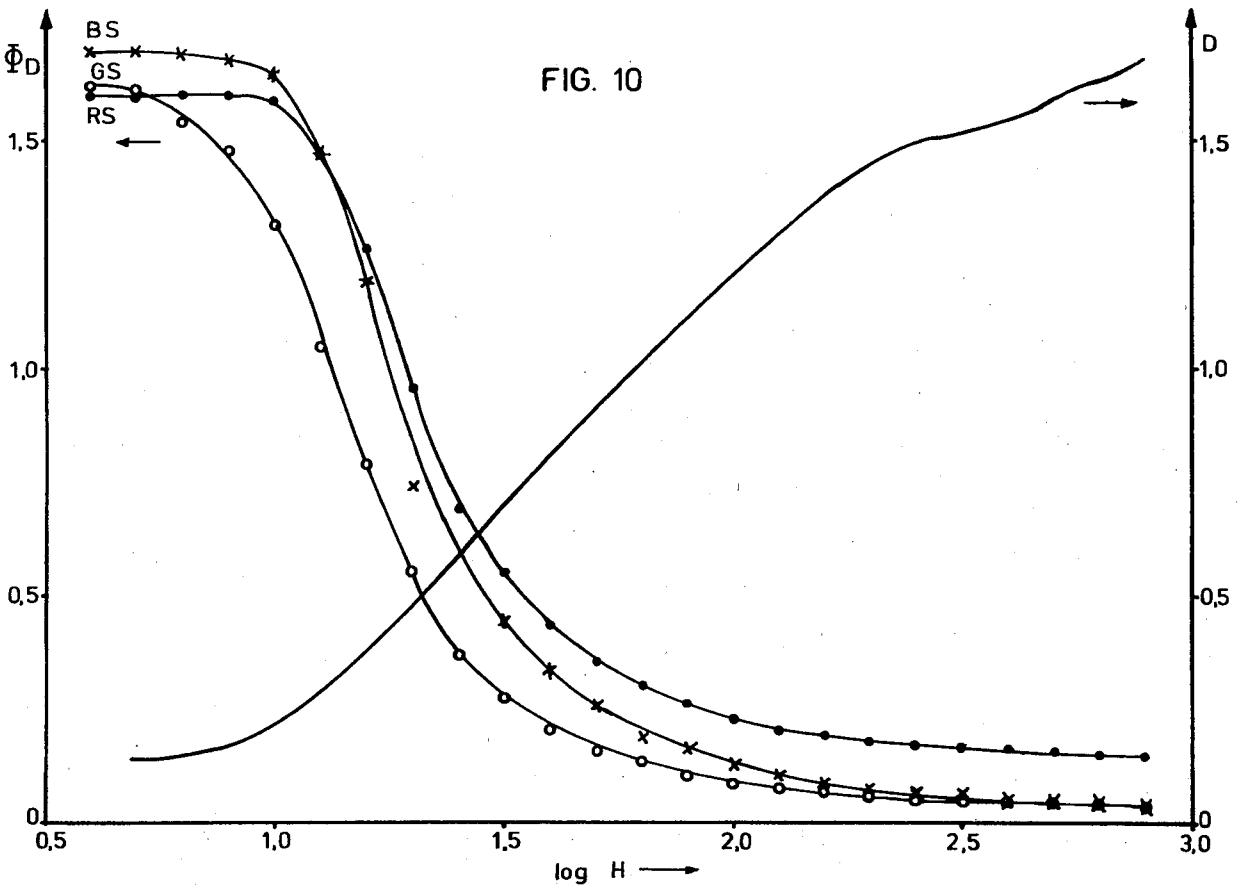
FIG. 10 illustrates color paper; white exposure and black-and-white processing.

The silver densities and the luminescence densities of the individual layers are represented in FIG. 10 in a corresponding manner for the daylight (white light) exposure.

EXAMPLE 7

The color paper described in Example 6, after separation or daylight exposure (as in Example 6) is subjected to a color processing at 33° C. as follows:

Developer II—3.5 min 900 ml of water
15 ml of benzyl alcohol
15 ml of ethylene glycol
3 g of hydroxylamine sulfate
4.5 g of 3-methyl-4-amino-N-ethyl-N-(β-methyl-sulfonamidoethyl)-aniline-sulfate
32 g of potassium carbonate sicc.
2 g of potassium sulfite sicc.
0.6 g of potassium bromide
1 g of 1-hydroxyethylidene-1,1-diphosphonic acid disodium salt
made up with water to 1000 ml,
adjusted to pH 10.2.

Blix—1.5 min
700 ml of water
35 ml of ammonia solution (28%)
30 g of ethylene diamine tetra-acetic acid
15 g of sodium sulfite sicc.
100 g of ammonium thiosulfate sicc.
60 g of sodium-ethylenediamine tetra-acetic acid iron-III-complex
made up with water to 1000 ml,
adjusted to pH 7.

Rinsing 3 min.

A test strip of this material, which had been exposed in the stated manner with green light (separation filter U 531) and had been processed, was scanned by the process described in Example 1 in an emission spectrometer (FLUOROLOG) using a transport apparatus according to FIG. 1 at a constant advance speed of 1 $cm.s^{-1}$ and with an exciting beam spot 2.5 mm wide and 10 mm high.

Measurement Conditions: $\lambda a/\Delta\lambda a/\lambda e/\Delta\lambda e=512/5/520/2$ nm.

Figure 11:
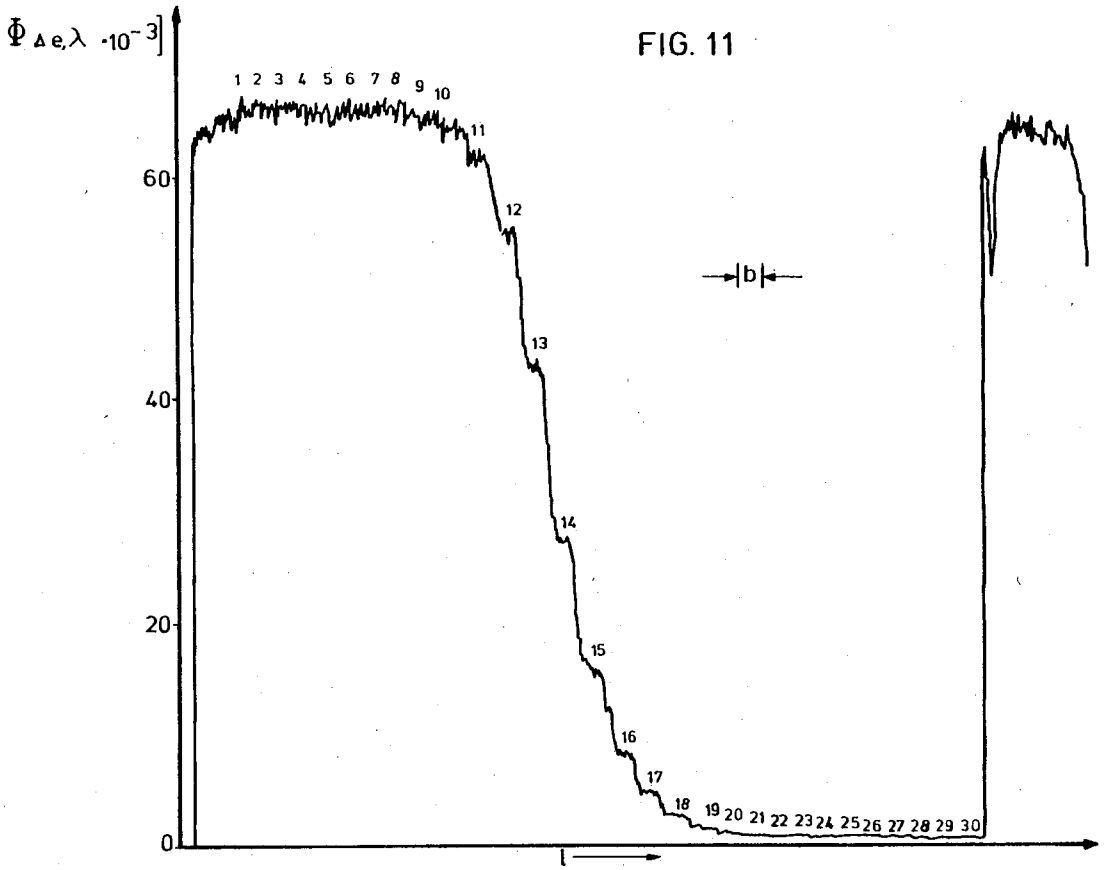
FIG. 11 illustrates a luminescence density curve of GS-1; separation exposure (U 531) and color processing.

The resulting measurement curve is represented in FIG. 11 (representation as in FIG. 2). As the exposure increased, i.e., as the wedge step number increases, the luminescence density greatly decreases. In the region beyond the 30 wedge steps which corresponds to the unexposed background the luminescence density has the same maximum value as in "fog" (wedge steps 1 to 10).

Figure 15:
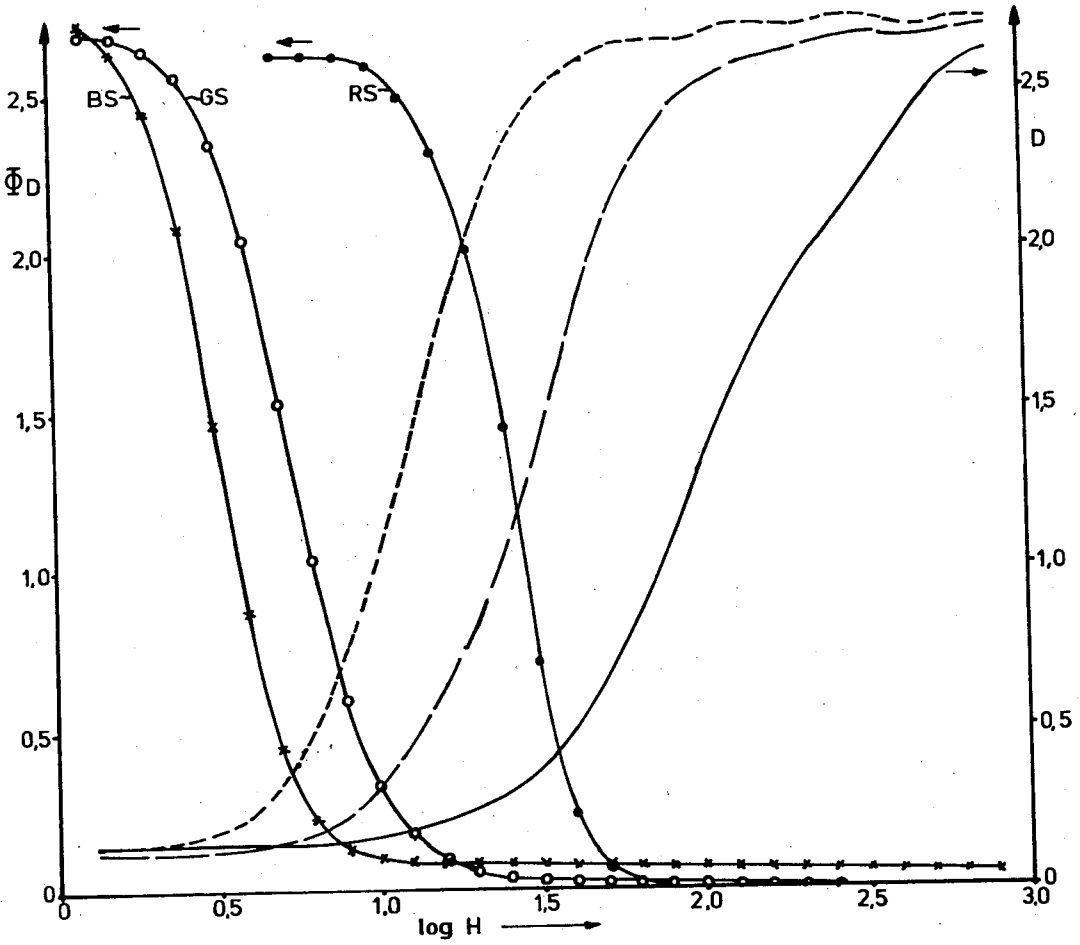
FIG. 15 illustrates color paper; white exposure and color processing.

FIGS. 12 to 15 represent the measurement results of the separation exposures blue (FIG. 12), green (FIG. 13) and red (FIG. 14) and of the daylight exposure (FIG. 15). The same representation was selected as in FIG. 3, but instead of the silver gradations, the corresponding color gradations were recorded, that is, as follows:

Yellow—short-dashed line
Magenta—long-dashed line
Cyan—full line.

The curves of the luminescence densities are denoted as follows:
(Denotation ≙ measurement points)
BS—cross
GS—circle
RS—dot.
Measurement Conditions:

| | λa | Δλa | λe | Δλe [(nm)] |
|---|---|---|---|---|
| BS-1 | 438 | 5 | 448 | 5 |
| GS-1 | 512 | 5 | 520 | 2 |
| RS-4 | 667 | 5 | 677 | 5 |

Figure 12:
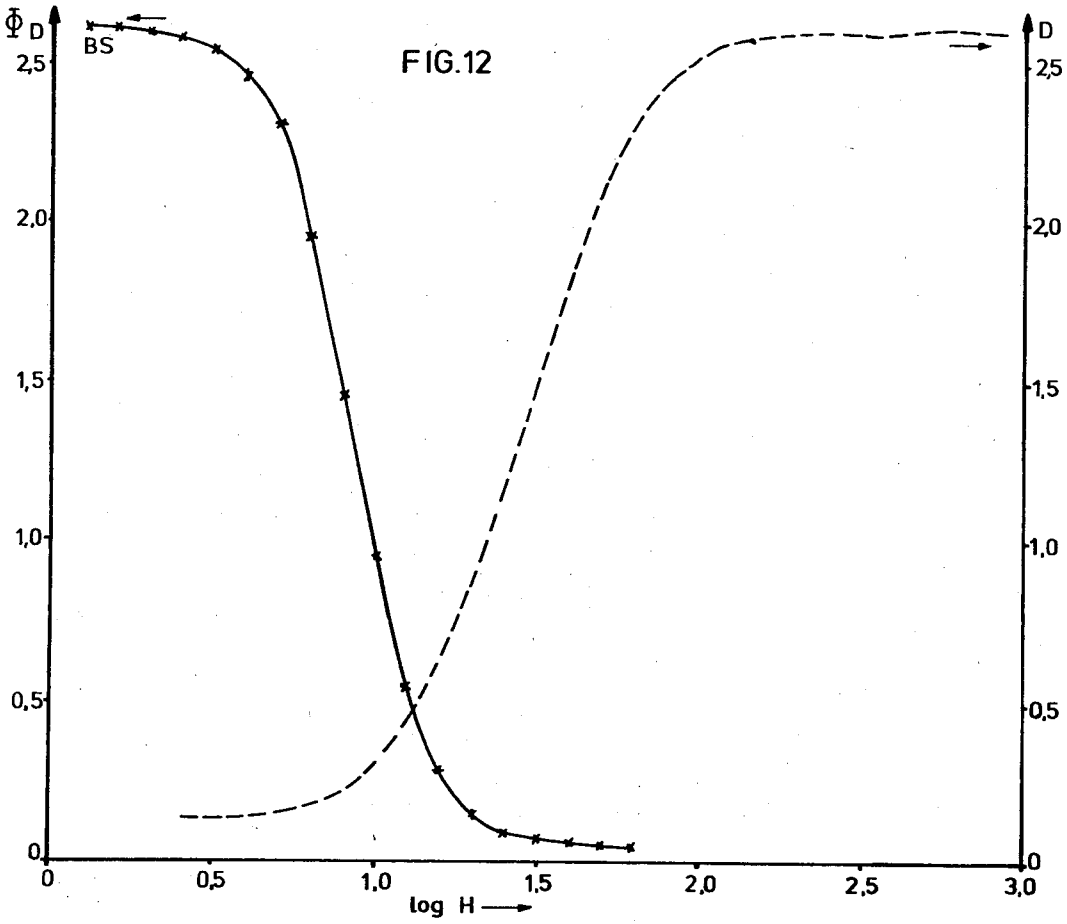
FIG. 12 illustrates color paper; separation exposure (U 449) and color processing.
Figure 13:
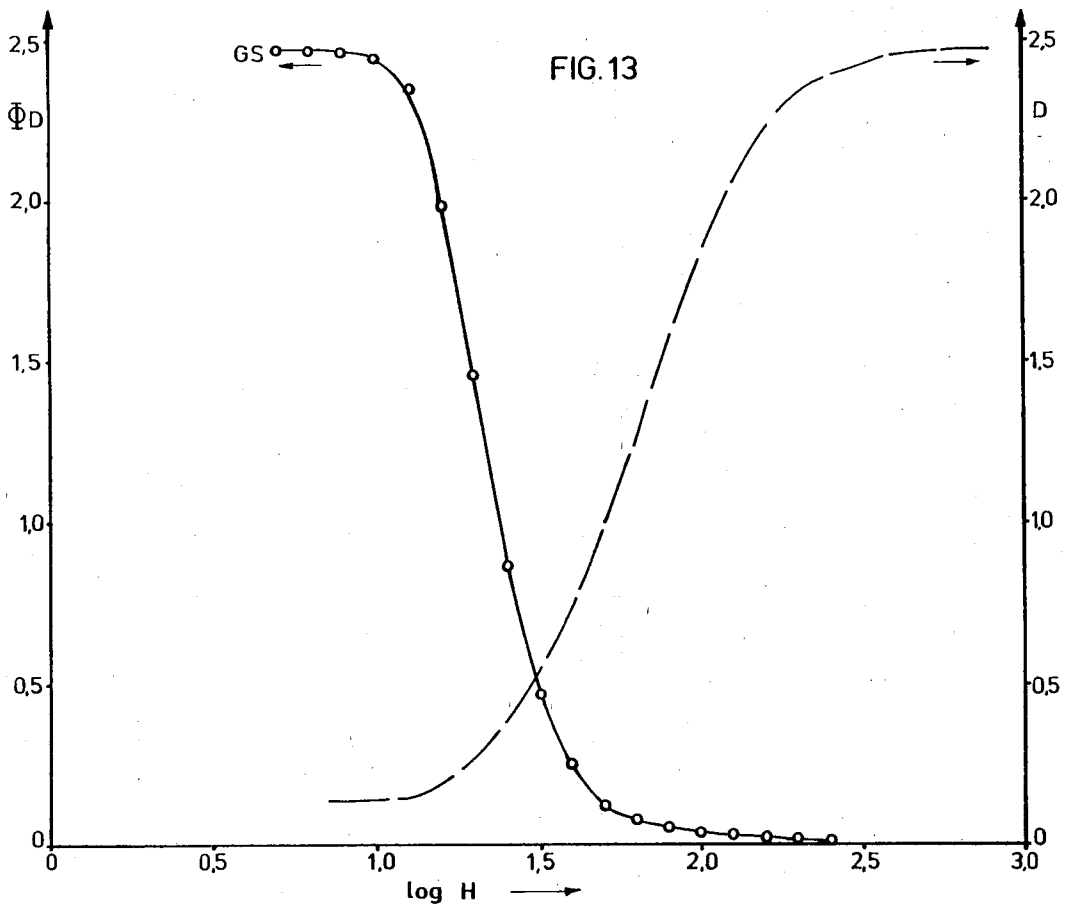
FIG. 13 illustrates color paper; separation exposure (U 531) and color processing.
Figure 14:
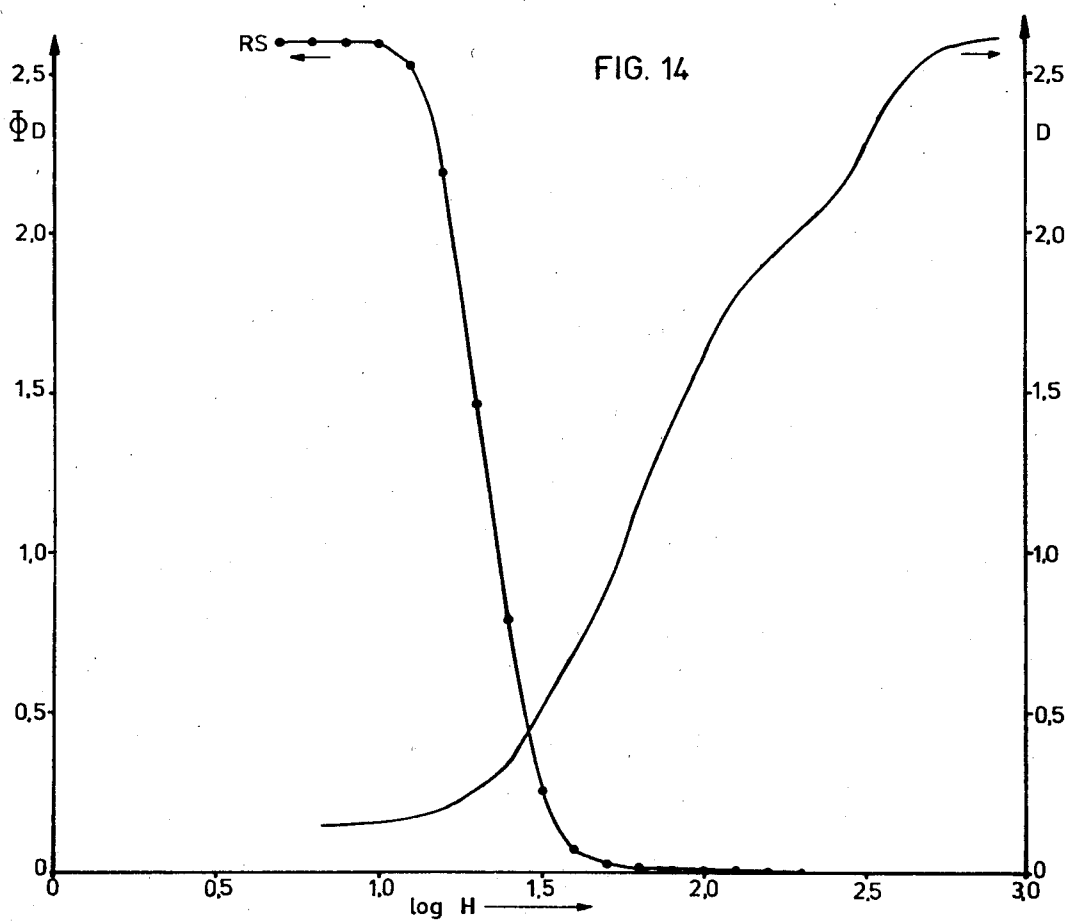
FIG. 14 illustrates color paper; separation exposure (L 622) and color processing.
Figure 16:
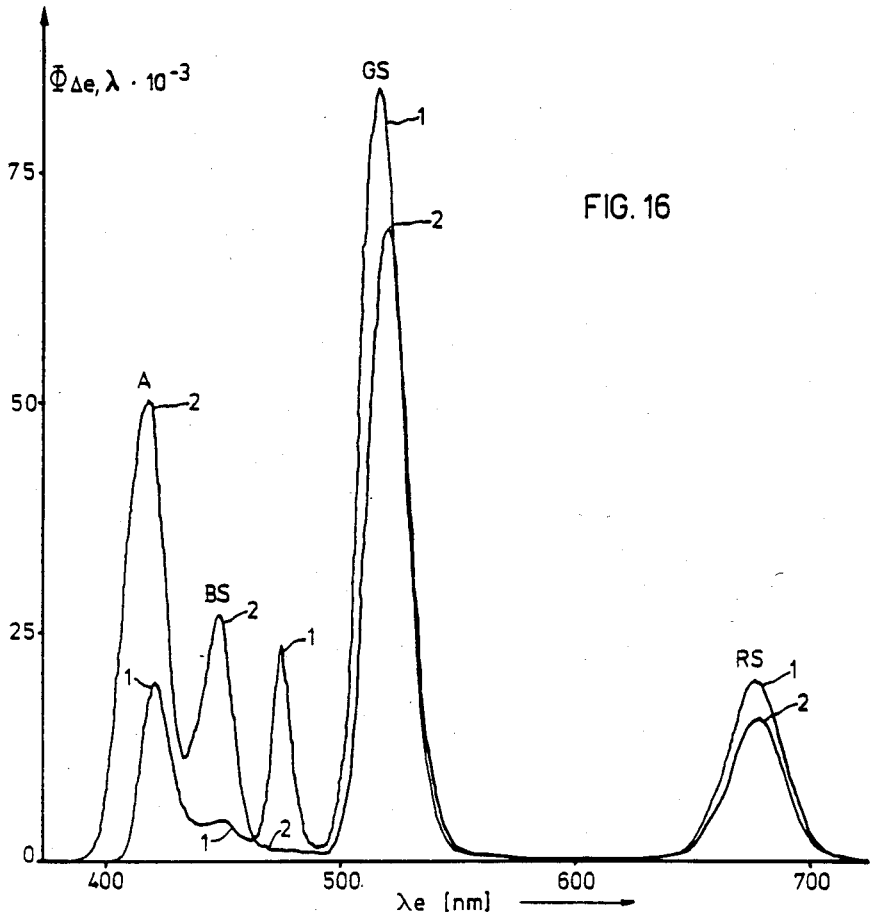
FIG. 16 illustrates color paper; emission product spectrum.

The normalization factors $K_e$ were as follows:
FIG. 12 (BS)—$1.84\times10^4$
FIG. 13 (GS)—$1.85\times10^4$
FIG. 14 (RS)—$2.52\times10^4$
FIG. 15
(BS)—$2.95\times10^4$
(GS)—$2.89\times10^4$
(RS)—$3.11\times10^4$ In FIG. 16, the emission spectrum of the unexposed unprocessed COLORPAPIER (curve 1) is compared with that of the unexposed, but color-processed, COLORPAPIER (curve 2). The spectral photon flux density $\Phi\Delta_e$, λ is plotted against the emission wavelength (measurement conditions as in FIG. 5). The short-wave band A at 418 nm corresponds to the optical brightener (compound No. 7) of the paper substrate. The bands at 448 nm and 475 nm are luminescence signals of the blue sensitizer BS-1, and the latter (475 nm) only occurs in the presence of silver halide, i.e., in unprocessed material. At 520 nm the green sensitizer GS-1 is luminescent, and at 677 nm the red sensitizer RS-4 is luminescent.

EXAMPLE 8

A "black noodle" (gelatin with finely-divided black silver) mixed with $1.5\times10^{-4}$ mol of GS-1/mol of Ag was cast on a polyethylene-coated paper substrate. The silver application was 0.67 g of $Ag/m^2$.

Figure 17:
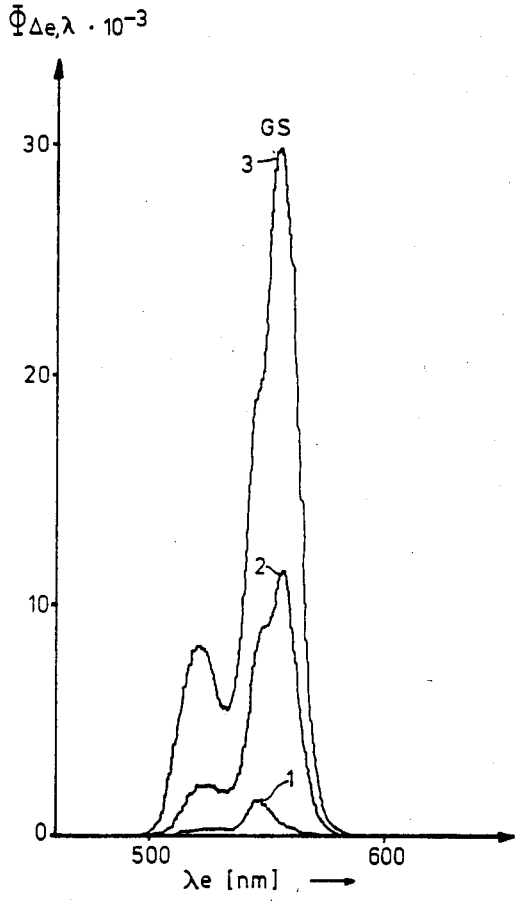
FIG. 17 illustrates emission product spectra of GS-1 in a silver layer after varying bleach fixing.

The emission product spectra of the green sensitizer GS-1 are represented in FIG. 17 for the samples specified in the following with different bleach fixing (see Example 7).

| Sample | Bleach fixing [min] | $Ag/m^2$* |
|---|---|---|
| 1 | 0 | 0.67 |
| 2 | 3 | 0.015 |
| 3 | 10 | 0 |

*after bleach fixing; determined by X-ray fluorescence method.

This shows that the luminescence of the green sensitizer is clearly quenched even by the smallest substance quantities of silver.

Measurement Conditions: $\Delta\lambda a/\Delta\lambda e=5/2$ nm; $\Delta\lambda=8$ nm.

EXAMPLE 9

A silver chloro-bromide emulsion sensitized with $1.76\times10^{-4}$ *mol of GS-1/mol of* $AgNO_3$, without couplers, was mixed with $4.10^{-3}$ and $4.10^{-2}$ mol/mol of $AgNO_3$ of a magenta dye corresponding to the following formula:

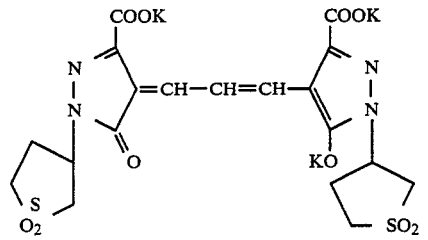

dissolved in methanol, and cast on a polyethylene-coated paper substrate. The silver application was 0.7 g of $AgNO3/m^2$.

The material was exposed behind a step wedge and behind the separation filters U 449 or U 531 and was subjected to color processing, as described in Example 7.

The processed samples show that the magenta dye is bleached together with the silver only on the exposed areas of the step wedge, and here gradually increasing with the exposure, in the inherent sensitivity range of the silver halide (U 449 separation filter) and in the sensitized spectral range (U 531 separation filter), whereas the unexposed background remains magenta in color.

We claim:

1. A photographic recording process, in which a latent luminescence image is produced by the image-wise exposure of a photosensitive photographic recording material, wherein a photographic recording material comprising at least one layer which contains photosensitive silver halide and at least one compound capable of luminescence is exposed image-wise and developed by a silver halide developer to thereby produce a silver image and a latent luminescence image superimposed on the silver image, and the image information contained in the latent luminescence image is scanned photoselectively by a luminescence spectroscopic process and is recorded electronically in the form of monochromatic luminescence signals.

2. The recording process as claimed in claim 1, wherein a silver image is produced by image-wise exposure and development in at least one layer of a photographic recording material which contains in said layer photosensitive silver halide and a uniform distribution of a compound capable of luminescence, the luminescence of said compound capable of luminescence being weakened image-wise (in the event of excitation) by said silver image, the silver image is scanned by a beam of monochromatic light of a wavelength suitable for the excitation of the luminescence of said compound capable of luminescence, and the image information in the form of the luminescence thus excited is detected quantitatively by an opto-electronic transducer device, is converted into electronic image signals and is recorded electronically.

3. The process as claimed in claim 2, wherein the electronic image signals obtained from the opto-electronic transducer device are used for the initial control of an apparatus for the production of visible images.

4. The process as claimed in claim 2, wherein at least one spectral sensitizer is used as the compound capable of luminescence.

5. The process as claimed in claim 2, wherein after development and before scanning the silyer image by a beam of exciting light, the photographic recording material is treated with means for removing the remaining silver halide.

6. The process as claimed in claim 2, wherein a photographic recording material having an opaque substrate is used.

7. The process for electronically recording including the steps of first image-wise exposure and development of a photosensitive photographic recording material comprising at least three silver halide emulsion layers of a photographic recording material, said three silver halide emulsion layers differing in spectral sensitivity and each containing a uniform distribution of a compound capable of luminescence, each of said compounds capable of luminescence contained in one of said three silver halide emulsion layers differing from said compounds capable of luminescence contained in others of said three silver halide emulsion layers in that it is excited by exciting light from a different partial region of the spectrum, whereby a silver image is produced in each layer, and each of said silver images thus produced represents a color separation image corresponding to the spectral sensitivity of the respective layer; and then scanning each of said color separation images by a beam of monochromatic light of a wavelength suitable for the excitation of the luminescence of the compound capable of luminescence contained in the respective layer, and the luminescence of the compound capable of luminescence contained in each of said three silver halide emulsion layers being weakened image-wise by the silver image in said layer; and then detecting quantatively by an opto-electronic transducer device the image information of each color separation image in the form of the luminescence thus excited;

converting the information into electronic image signals and recording electronically.

8. The process as claimed in claim 7, wherein the electronic image signals from each of the color separation images are useful for the initial control of an apparatus for the production of a monochromatic visible partial image of another color and a multi-colored image is produced by the combination of the differently colored partial images.

9. The process as claimed in claim 7 wherein color separation images of the primary colors blue, green and red are recorded by using a photographic recording material having a blue-, a green- and a red-sensitized silver halide emulsion layer.

* * * * *